United States Patent [19]

Webb et al.

[11] Patent Number: 4,606,417

[45] Date of Patent: Aug. 19, 1986

[54] PRESSURE EQUALIZED STABILIZER APPARATUS FOR DRILL STRING

[76] Inventors: Derrel D. Webb, Edwin A. Anderson, both of P.O. Box 567 Houston, Tex. 77001

[21] Appl. No.: 720,980

[22] Filed: Apr. 8, 1985

[51] Int. Cl.[4] ..... E21B 7/10

[52] U.S. Cl. ..... 175/76; 175/325

[58] Field of Search ..... 175/61, 76, 83, 227, 175/228, 325; 308/4 A, 6 A; 166/237

[56] References Cited

U.S. PATENT DOCUMENTS

| | | | |
|---|---|---|---|
| 2,065,896 | 12/1936 | Keever | 175/83 |
| 3,007,750 | 11/1961 | Cunningham | 175/227 |
| 3,007,751 | 11/1961 | Eenink | 175/227 |
| 3,370,657 | 2/1968 | Antle | 175/325 |
| 4,284,154 | 8/1981 | England | 175/325 |
| 4,386,667 | 6/1983 | Millsapps, Jr. | 175/227 |
| 4,408,485 | 10/1983 | McGill | 166/237 |

*Primary Examiner*—James A. Leppink
*Assistant Examiner*—Terry Lee Melius
*Attorney, Agent, or Firm*—Jack W. Hayden

[57] ABSTRACT

An elongated mandrel has enlargements adjacent each end with a reduced diameter mandrel section extending therebetween. A stabilizer member is supported on the mandrel section by bearing surfaces for relative rotation of the mandrel with a well string when the stabilizer member engages a well bore wall. Spaced seals and wipers between the mandrel and stabilizer member form a closed reservoir for receiving lubricant, and a passage that communicates with the reservoir and the well bore has a floating piston therein responsive to well bore pressure to equalize the well bore and reservoir pressure without exposing the lubricant in the chamber to well bore contaminants.

3 Claims, 5 Drawing Figures

FIG. 1
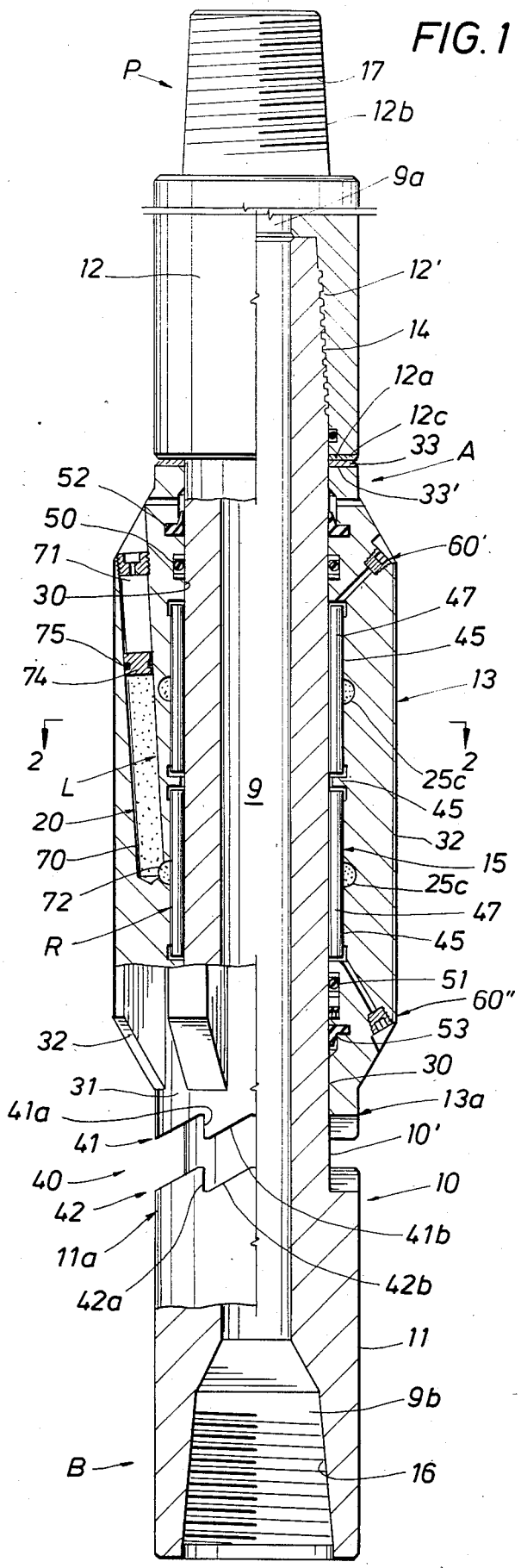
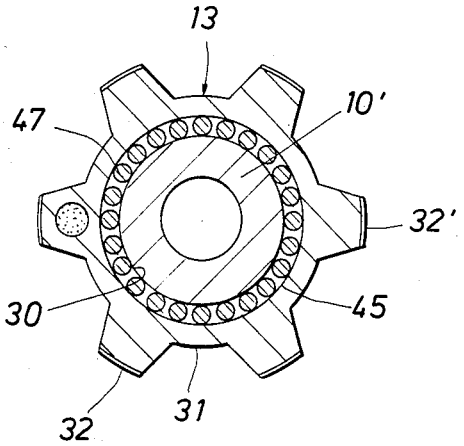
FIG. 2

PRESSURE EQUALIZED STABILIZER APPARATUS FOR DRILL STRING

BACKGROUND OF THE INVENTION

1. Field of the Invention

The present invention relates to a stabilzer and method for maintaining a drill string on a desired course during drilling operations to drill a well bore.

2. Description of the Prior Art

During the process of drilling a well there are constant, yet variable, forces applied to the drill bit and the drill string assembly. As the bit penetrates the formations being drilled these forces may induce deviation of the drill string from a desired course while drilling either a so-called "straight hole" (vertical or horizontal) or a deviated well bore. A few of the forces applied are from such sources as the dip of the formation being drilled or bored; the weight applied on the drill bit during penetration; the revolutions per minute of the drilling bit while penetrating the formation; the types of changing formation being penetrated; the angle of the well bore being drilled, and the like.

In vertical drilling operations, the force of gravity on a drill bit and drill string acts favorably in producing a vertical hole, however, the differences in formation make up and consistency along with the dynamic forces of the bit and drill string can produce significant intentional or unintentional deviations.

One method that is used to control the hole angle has been the technique of using the "pendulum" principle, that is, the proper placement of stabilizers in the lower drill collar assembly to provide fulcrum points so that the hole angle of the bore hole from the vertical may be increased or decreased depending on the correction required. Once the hole angle has been established it is common practice to "pack" the hole or the lower drilling assembly with stabilizers so as to maintain hole angle and prevents lateral movement of the bit. A common type of stabilizer which has been used is a fixed blade stabilizer that rotates with the drill string. Fixed blade stabilizers that rotate with the drill string tend to drill away the hole wall, thus permitting the drill bit to move laterally and off of the desired bit course.

In addition to hole angle deviation from a vertical standpoint, bore holes drilled with ordinary earth drilling tools may deviate with respect to a fixed reference generally taken as "north or south" with respect to the earth poles. Intentional or unintentional polar deviation in conjunction with the above mentioned vertical deviation, constitute the art, science and craftmanship of "directional drilling". Once the art, science, and craftmanship of the numerous methods of "directional drilling" have been applied, it is the purpose of this device, when knowledgeably used, to assist in the hole control with respect to both vertical and directional deviations and also to the straightness of the hole once the intentional deviations have been achieved.

Another type of stabilizer that has been in use is that of a non-rotating stabilizer. In general non-rotating stabilizers are more effective in controlling the hole angle due to the fact that rotatable tools may tend to drill the hole off course due to factors such as those mentioned above. With this type of stabilizer, the mandrel of the stabilizer rotates within the stabilizer member and must be lubricated. In the past, this has been accomplished by utilizing drilling fluid as a lubricant in combination with holes that are drilled in the member through which the fluid enters. In general the stabilizer sleeve is provided with a number of radially extending and circumferential spaced blade members. The furthest extension of the blades is generally seen to be that of the outer diameter of the drill bit, but generally not beyond that diameter. For example, when a $9\frac{7}{8}''$ drilling bit is used to drill a well bore, and drill pipe stabilizers are installed in the drill string to limit deviation, the maximum diameter of the stabilizers is also $9\frac{7}{8}''$ or the same as the bit.

SUMMARY OF THE INVENTION

One of the objects of the invention of the present method and apparatus is to provide a new and improved method and apparatus for controlling and eliminating well bore deviation from a designed course. Accordingly, the present invention provides apparatus constructed for long term use by the utilization of a pressure compensator to equalize forces caused by outside well bore pressure on seals that contain the lubricant for the enclosing bearing system. It is also an object to enclose and isolate the lubricant from the fluid in the well bore to prevent contamination of the lubricant by well bore fluid and thus reduce wear and damage to the internal components of the stabilizer.

It is further an object that the pressure compensation of the present invention be responsive to well bore pressure in order to equalize the pressure across the seals and prevent contamination of the enclosed lubricant. Likewise, it is an object that the pressure compensation of the present invention in preventing contamination of the enclosed lubricant prevent premature damage to the enclosed bearing system and other components.

It is even further an object of the present invention that the apparatus provide a clutch mechanism that will not hinder free rotation of the mandrel, but will lock when a washover cutter tool is lowered over the stabilizer ribs to enable removal of the ribs in event the tool becomes stuck in the hole.

Still yet another object of the present invention is to provide a rotating member having means for dispersing an amount of lubricant as it rotates within a stabilizer element, thus lubricating the sliding surfaces between the rotating member and the stabilizer element.

It is a feature of the invention that the apparatus has long term wear provisions provided by enclosing the bearing system and its lubricant.

Other objects and advantages of the invention will become apparent from a consideration of the following drawings and description.

BRIEF DESCRIPTION OF THE DRAWINGS

FIG. 1 is a sectional view, partly in elevation of one embodiment of the present invention;

FIG. 2 is a cross-sectional view on the line 2—2 of FIG. 1 showing one form of bearing means to support the stabilizer member of the apparatus of the invention in engagement with a well bore wall while the mandrel extending through the stabilizer member and connected drill string rotate relative thereto;

DESCRIPTION OF THE PREFERRED EMBODIMENTS

Figure 3:
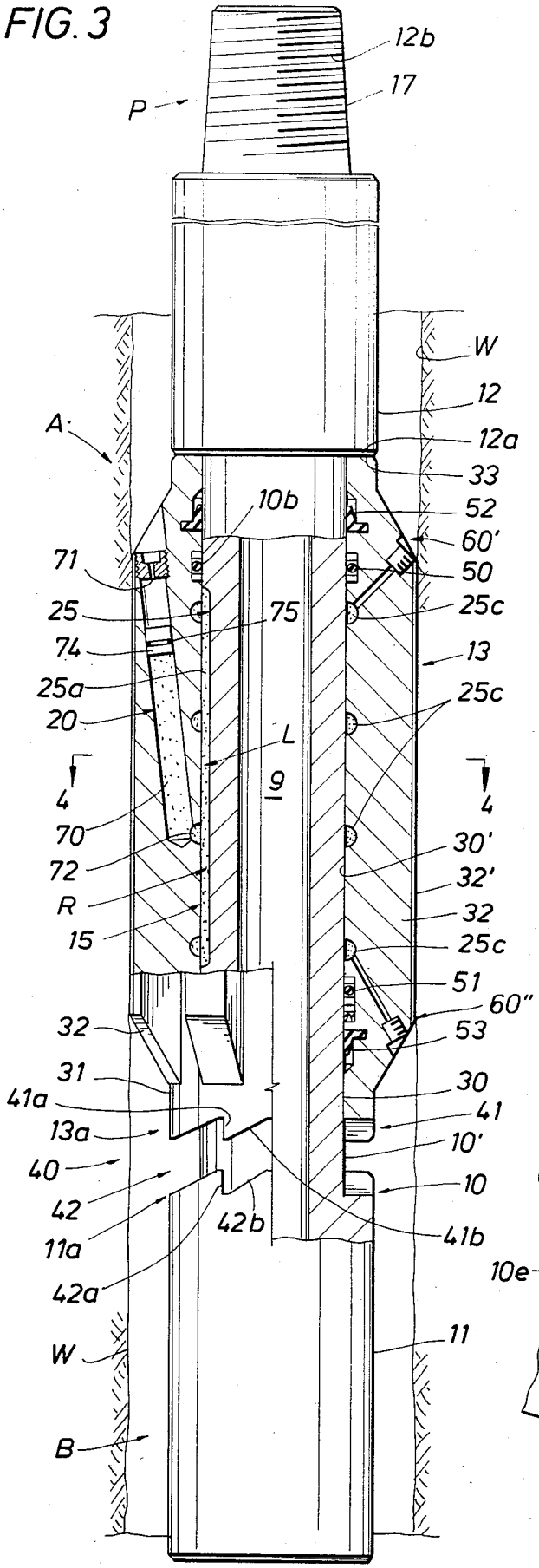
FIG. 3 is a sectional view, partly in elevation of another embodiment of the present invention diagrammatically illustrating it positioned in a well bore.
Figure 4:
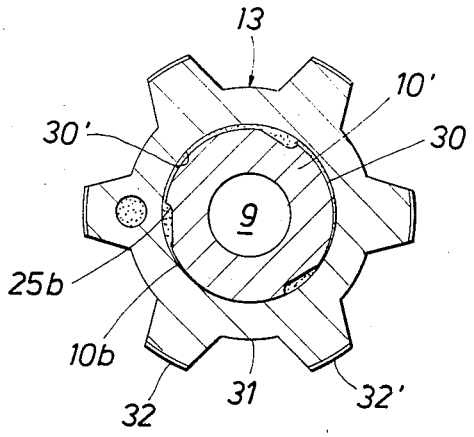
FIG. 4 is a cross-sectional view taken along the line 4—4 of FIG. 3 illustrating an alternate form of bearing means.

In FIGS. 1 and 3 preferred embodiments of the drilling string stabilizer of the present invention are illustrated which can be employed in practicing the method of the present invention to orient the drill string and drill bit associated therewith while drilling a well bore to maintain the well bore on a desired course. The apparatus is referred to generally by the letter A and includes means for connecting to a conventional drill string (not shown) that includes a drill bit (not shown) attached to its lower end. The apparatus A is secured or connected in the drill string above the bit and it is constructed to pass rotary motion of the drill string through the apparatus A for rotation of the drill bit.

The specific form of the arrangement for practicing the present invention includes an elongated tubular mandrel 10 having a central bore 9 extending longitudinally therethrough. Threaded means in the form of a pin P and box B are provided adjacent each end of the elongated tubular mandrel 10 for threadedly connecting the apparatus A in the drill string for rotation therewith.

An elongated stabilizer member referred to generally at 13 is supported on the mandrel 10 and is configured for frictional engagement with the wall of the well bore as will be described in greater detail.

The apparatus A includes bearing means 15 to rotatably support the stabilizer member 13 on the member 10 so that while the stabilizer member 13 is frictionally engaged with the wall of the well bore, the mandrel 10 and drill string may be rotated relative thereto to drill the well bore.

Means referred to at 20 are provided to equalize the pressure of the well bore surrounding the apparatus with the pressure in an isolated reservoir for receiving lubricant for lubricating the bearing means 15 as will be described.

The tubular mandrel 10 includes adjacent each end thereof enlargements 11 and 12 with a mandrel section 10' extending therebetween which is of a smaller outer diameter than the outer diameter of the enlargements 11 and 12 as illustrated. The enlargement 11 is shown as being integrally formed with mandrel section 10' and as is better illustrated in FIG. 1 enlargement 12 is threadedly engaged with the other end of mandrel section 10' by mating threads 14 formed on the end of mandrel section 10' and in the bore 12' of enlargement 12. A longitudinal central bore **9*a* is provided in enlargement 12 which communicates with and forms a continuation of the central bore 9 through the apparatus A. The enlargement 11 is provided with a bore 9*b* having threads thereon which form the internally threaded box means 16 and enlargement 12 is provided with threads 17** for threadedly forming the pin end P.

The stabilizer member 13 is provided with a longitudinal, central bore 30 therethrough for receiving the mandrel section 10' and is provided on it outer periphery 31 with circumferentially spaced and generally longitudinally extending ribs or projections 32 for fictionally engaging with the well bore wall during drilling operations. If desired the longitudinally extending edges 32' of ribs 32 may be treated or provided with suitable wear resistant material to prolong the life of the ribs. While the blades at 32 are illustrated as extending parallel to the longitudinal axis of the stabilizer member 13, in some instances it may be desirable to provide the blades means 32 in other configurations such as spirals or the like.

The annular end surface 33 of stabilizer member 13 abuts the annular end surface or edge **12*a* of enlargement 12 and provides a bearing arrangement during rotary drilling operations and if desired the annular end surface or edges 33 and 12*a* may each be provided with a hardened surface or wear resistant surface 33' and 12*c*** respectfully.

A clutch mechanism or arrangement 40 is provided adjacent the end **13*a* of stabilizer member 13 and the end 11*a* of enlargement 11 which enables relative rotation to occur between mandrel 10 and stabilizer member 13** in one direction, while preventing relative rotation therebetween in the opposite direction.

The clutch mechanism 40 may assume any suitable arrangement to enable an outside cutter to be washed over the apparatus A should it become stuck in a well bore to mill or cut the ribs 32 in a manner well known in the art for retrieval of the apparatus A and stuck portion of the drill string from the well bore.

As shown, the clutch mechanism 40 includes a downwardly facing surface means referred to generally at 41 on the end annular edge **13*a* of centralizer member 13 and upwardly facing surface means referred to generally at 42 on the end annular edge of enlargement 11 formed at the juncture of smaller diameter mandrel section 10'** therewith.

The surface means 41 include a plurality of circumferentially spaced longitudinally extending portions **41*a* which are parallel to the longitudinal central axis of stabilizer member 13. The surfaces 41*a* are connected by cam surface 41*b* which slope upwardly from the outer most edge of surface 41*a* to the innermost edge of the next adjacent surface 41*a* as illustrated in the drawings. Similarily surface means 42 include surfaces 42*a*, 42*b*, for mating with 41*a* and 41*b* respectively when the surfaces 41*a*, 42*a*, and 41*b*, 42*b* abut so that relative rotation between stabilizer member 13 and mandrel 10** is prevented in one direction.

It will be noted that the stabilizer member 13 is of less longitudinal extent than the distance between the annular end surfaces **11*a* on enlargement 11 and the annular end surface 12*a* on enlargement 12 so that during normal drilling operations with weight on the drilling string and with the stabilizer member 13 engaged with the wall of the well bore, the apparatus assumes the position shown in FIGS. 1 and 3 of the drawings so that the clutch mechanism 40 remains disengaged during normal drilling operations. The fluid circulated down through the drill string and upwardly in the annulus of the well bore during drilling operations also assists in maintaining the stabilizer member 13 in the position shown in FIGS. 1 and 3. However, should the apparatus A become stuck in the well bore so that it cannot be retrieved, a washover tool of well known configuration can be lowered downwardly thereover and rotated so as to urge the stabilizer member 13 downwardly and to engaged the clutch 40** whereupon a milling device or cutter arrangement on the wash over apparatus mills or cuts the blades as previously noted.

In FIG. 1 the bearing means 15 is shown as comprising roller bearings and in FIG. 3 the bearing means 15 is shown as being in the form of a journal bearing.

As better illustrated in FIG. 2 a plurality of rows of longitudinal cavities 45 is formed between the stabilizer member 13 and mandrel section 10'. As illustrated, the cavities 45 are shown as being formed in the bore 30 of stabilizer member 13 and are aligned axially with the longitudinal central axis of the mandrel 10. Two rows of cavities 45 are illustrated in FIG. 1 with a plurality of roller bearings 47 positioned in each cavity 45 as shown. In this manner the roller bearings 47 engage both the the mandrel section 10' and stabilizer member 13 to accommodate relative rotation therebetween. The two rows of cavities may be separated and further defined by an annular projection or shoulder 45' to assist in positioning the roller bearings 45 in each cavity.

In FIG. 3 the journal bearing means of FIG. 3 is formed by the mandrel section 10' which forms a journal pin that generally mates with the annular surface 30' of the bore 9 through the stabilizer member 13. If desired the surface of the mandrel section 10' and the surface 30' may be surface hardened or given special treatment to increase wear resistance and provide protection against galling.

A lubricant reservoir R is formed between the stabilizer member 13 and mandrel section 10' by the longitudinally spaced seals 50 and 51 sealably engaging the between the mandrel section 10' and stabilizer member 13 as well as the wiper elements 52 and 53 which are positioned longitudinally from the seal means 50, 51 to enclose them. The reservoir R is thus defined by the longitudinally spaced seal means 50, 51 and wiper means 52, 53 which isolate the bearing means 15 from well bore fluids and which is adapted to receive lubricant referred to by the letter L therein for lubricating the bearing means 15. The seal means 50, 51 and wiper means 52, 53 are of any suitable well known material such as elastomer or the like which will not react with the lubricant employed, and are positioned in suitable groove means as illustrated in the drawings to sealably engage between the stabilizer member 13 and mandrel section 10'.

Figure 5:
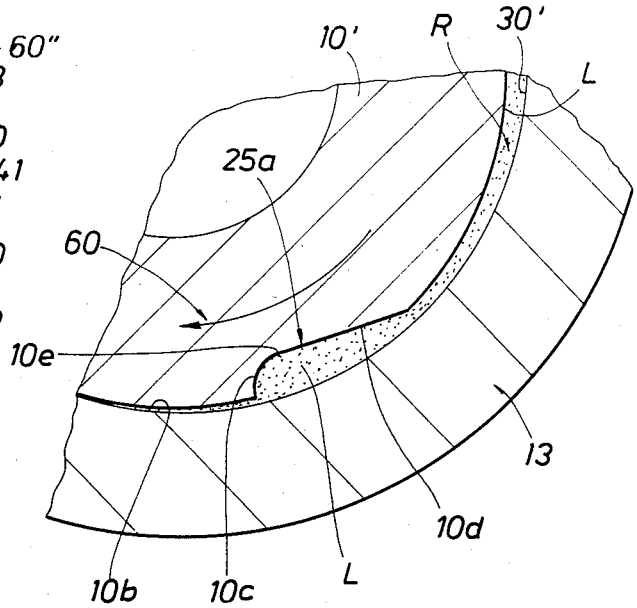
FIG. 5 is an enlarged partial sectional view illustrating in greater detail the bearing means of FIG. 3 and lubrication arrangement therefor.

In FIG. 3 the journal bearing means 15 includes a longitudinal extending cavity **25*a* shown as being formed on the outer periphery 10*b* of the mandrel section 10*b* and extends substantially the extent of the reservoir R. The longitudinal cavity 25*a* has a longitudinally extending, generally curved leading surface 10*c* projecting inwardly from the surface 10*b* toward the longitudinal axis of the mandrel section 10' and joins at its curved inner end 10*e* with a longitudinally extending trailing surface 10*d* formed generally on a cord of said mandrel section. Thus, as the mandrel is rotated as represented by the arrow 60 in FIG. 5, lubricant at L is wiped from cavity 25*a* forming part of the reservoir R and is distributed to whatever reservoir space exists between the journal pin formed by the mandrel section 10' and the inner mating surface 30' of bore 30 formed in stabilizer member 13**. Lubricant L may be any heavy duty hydrocarbon journal bearing lubricant or any combination of dissimilar bearing metals such as silver, copper or zinc metallic deposits that function as lubricants and anti-galling agents in combination with any liquid lubricants.

To further assist in distribution of the lubricant L within the reservoir R to provide lubrication for the journal bearing means 15, a plurality of longitudinally spaced annular recesses **25*c* extend between said mandrel section 10' and stabilizer member 13 and are shown as being formed in stabilizer member 13. The recesses 25*c* communicate with the end 72 of passage means 70 and with the cavities 45 in the FIG. 1 form of bearing means and with the longitudinally extending air foil shaped cavity 25*a* in the FIG. 3 form of bearing means for assisting in distributing liquid lubricant between the mandrel section 10' and stabilizer member 13**.

Suitable means as illustrated at 60' including passage means in stabilizer member 13 are provided for supplying lubricant to the reservoir L. The passage means may be closed by any suitable cap means as shown in the drawings. Vent passage 60'' and also provided and are of any suitable configurations as shown.

Pressure equalizing means 20 are also provided for equalizing the pressure within the lubricant reservoir R with the pressure in the well bore annulus surrounding the apparatus A. Such means include passage means 70 formed in the stabilizer member 13 and having one end 71 that communicates with the well bore annulus through an opening in the threaded plug secured in the end 71 of passage 70 as shown. The other end 72 communicates with the reservoir R formed in the apparatus A between the mandrel 10 and stabilizer member 13. Piston means 74 are provided in the passage 70 intermediate the ends thereof and include seal means 75 which sealably engage the wall of the passage means 70 whereby pressure from the well bore annulus may be transmitted to the lubricant L in the passage means 20 and the reservoir R. The pressure in the well bore annulus may be substantial and this pressure is transmitted to the lubricant in the reservoir R to assist in distributing the lubricant and maintaining lubricant on bearing means 25 in both the FIG. 1 and FIG. 3 bearing means 25 to maintain proper lubrication thereof. Also, this arrangement while equalizing the pressure maintains the bearing means 25 isolated within the reservoir R so as to avoid contamination of the lubricant within the reservoir R as well as inhibiting damage to or galling of the bearing means 25 by foreign matter exterior of the apparatus A in the well bore. In this manner, the seal means 50, 51, wiper means 52, 53 and pressure equalizing means 20 provide an arrangement for isolating and encapsulating the bearing means 15 within the lubricant L maintained in the reservoir R to accomplish the lubrication and resulting advantages hereinabove mentioned.

In use, the apparatus is secured in the drilling string above the bit and lowered into the well bore to be drilled. The ribs or projections 32 on stabilizer member 13 frictionally engage with the wall W of the well bore and as rotation of the drill string is maintained during drilling operations, the ribs maintain frictional engagement with the wall W and thus are are stationary. Also, the weight of the drill string acting down on stabilizer member 13 along with the pressure of the fluid in the well bore annulus circulating upwardly around the apparatus A maintain the stabilizer member 13 in spaced relationship so as to keep the clutch 40 disengaged during normal drilling operations.

During such drilling operations the bearing means 15 rotatably supports mandrel section 13 on mandrel section 10' and is isolated within the reservoir R in the manner as above described herein. The reservoir R is filled with lubricant L before the apparatus A and well string are lowered into the well bore and the lubricant L is maintained under pressure by the well bore pressure which assists in disbributing lubricant from the reservoir R for lubricating the bearing means 15. However, the lubricant L is isolated from the fluids in the well bore since the reservoir R and the equalizing means at 20 are constructed and arranged as previously described to prevent communication of well bore fluids to the reservoir R and to the lubricant L within the equalizing means 20.

The foregoing disclosure and description of the invention are illustrative and explanatory thereof, and various changes in the size, shape and materials as well as in the details of the illustrated construction may be made without departing from the spirit of the invention.

What is claimed is:

1. Apparatus for controlling the direction of a well bore being drilled by a drill string with the bit thereon comprising:

a tubular mandrel having an enlargement adjacent each end thereof to provide a mandrel section between said enlargements which is of smaller outer diameter than the diameter of said enlargements;

a stabilizer member on said mandrel section;

said stabilizer member having a plurality of longitudinally extending, circumferentially spaced projections for frictionally engaging the well bore wall to maintain said stabilizer member fixed against rotation while the drill string is rotated to drill the well bore;

said stabilizer member being of less longitudinal extent than the length of said mandrel section between said enlargements to accomodate relative longitudinal movement between said tubular mandrel section and stabilizer member;

isolating means between said mandrel section and stabilizer member;

said isolating means including seal means and wiper means adjacent each end of said stabilizer member for sealably engaging between said mandrel section and stabilizer member to form a longitudinally extending reservoir therebetween to receive lubricant therein;

bearing means extending longitudinally between said seal means within said lubricant reservoir and movable therewith to accomodate relative longitudinal and rotational movement between said tubular mandrel section and stabilizer member;

pressure equalizing means carried by said stabilizer member and movable longitudinally and rotatably therewith to communicate pressure from the well bore to the lubricant reservoir between said mandrel section and stabilizer member irrespective of the longitudinal position of said reservoir along said mandrel section between said isolating means;

said pressure equalizing means comprising passage means having one end communicating with the well bore and the other end communicating with the lubricant reservoir, and piston means in the passage means between the ends thereof, said piston means having seal means sealably engaging the passage means to transmit pressure from the well bore to said lubricant reservoir while inhibiting communication therebetween; and a clutch mechanism between said mandrel and stabilizer member to accommodate rotation of said mandrel relative to said stabilizer member in one direction while preventing rotation between said stabilizer member and mandrel in the opposite direction.

2. The apparatus of claim 1 wherein said bearing means are formed by said mandrel section which forms a journal pin that mates with the stabilizer member rotatably supported on said pin to form journal bearing means; said lubricant reservoir enclosing said journal bearing a longitudinal cavity in said mandrel section within the lubricant reservoir, said longitudinal cavity having a curved longitudinally extending leading surface projecting toward the longitudinal axis of said mandrel and joining at its inner end with a longitudinally extending trailing surface formed on a chord of said mandrel section; and a plurality of longitudinally spaced, annular recesses in said stabilizer member communicating with said longitudinal cavity, said passage means communicating with said longitudinal cavity and annular recesses whereby lubricant may be distributed to said journal bearing means within said reservoir.

3. The apparatus of claim 1 wherein said bearing means include cavity means in said stabilizer member extending longitudinally between said seal means within said lubricant reservoir, the axis of said cavity means being aligned with the axis of rotation of said mandrel and roller bearing means extending longitudinally in said cavity within said lubricant reservoir and engaging said mandrel section and stabilizer member to accommodate relative longitudinal and rotational movement between said mandrel section and stabilzer member.

* * * * *